US005271616A

United States Patent [19]

Grimaldi

[11] Patent Number: 5,271,616

[45] Date of Patent: Dec. 21, 1993

[54] PITCHING TARGET APPARATUS

[76] Inventor: Anthony J. Grimaldi, 175 Pearl St., Kingston, N.Y. 12401

[21] Appl. No.: 951,769

[22] Filed: Sep. 28, 1992

[51] Int. Cl.[5] ..... A63B 61/00

[52] U.S. Cl. ..... 273/26 A; 273/394; 273/397

[58] Field of Search ..... 273/26 A, 29 A, 26 R, 273/30, 407, 408, 410, 177 B, 181 R, 181 F, 181 G, 181 K, 182 R, 402, 384–401

[56] References Cited

U.S. PATENT DOCUMENTS 1,540,670 6/1925 Vidmer ..... 273/410
1,745,201 1/1930 Alston ..... 273/181 R
2,059,365 11/1936 King ..... 273/397
2,657,058 10/1953 Mulcahy ..... 273/26 A
3,156,471 11/1964 Bibeau ..... 273/182 R
3,157,399 11/1964 Gaudet ..... 273/26 A
3,197,208 7/1965 Makar ..... 273/26 A
3,761,085 9/1973 Cook ..... 273/30
4,475,734 10/1984 Clarke ..... 273/410

*Primary Examiner*—Theatrice Brown

[57] ABSTRACT

A pitching device for training pitchers including a pitching target suspended within a retaining chamber with a collecting means located in the lower portion of the retaining chamber and a gravity return from the collecting means back to the pitchers. The retaining chamber includes a floor panel which slopes both to one side of the pitching device and forward to an outlet connected to the gravity return.

6 Claims, 3 Drawing Sheets

PITCHING TARGET APPARATUS

BACKGROUND OF THE INVENTION

The present invention relates to a pitching device with a gravity return and more particularly to a pitching device with a retaining chamber in which a target means is suspended recessed within the retaining chamber and with a collecting means in the lower portion of the retaining means. The collecting means directs the baseballs by gravity to an outlet which is connected to a gravity return.

Various target devices are known and disclosed in the prior art. The concept of throwing at some type of a target and being hopefully able to collect the thrown baseballs has been shown in numerous embodiments. Certain of the various patents also show a return means normally using a chute of some type for directing the baseballs back to the pitcher. However, most of the known devices do not use a return. Where the baseballs are returned, the known units frequently have a system for either throwing the ball back or lifting the ball high in the air onto a conveyor to send the baseballs back to the pitcher.

Some of these devices are usable and provide a helpful means to a person learning to throw a baseball to develop skill without assistance from other players such as a catcher to receive the baseballs. Such devices permit a pitcher to train independently of other people and know when the thrown ball is in fact thrown into the strike zone as required by the game of baseball.

The targets themselves are also of various types. A plain impact receiving mat is known, but numerous of the inventions have used flags and spinners and buttons of various types, as well as even complicated electronic devices to show where the baseball is struck. The spinners and the flaps, for example, are mounted on an axis or a supporting cord, and, unfortunately, only too often, the baseball, rather than hitting the spinners or flages, strikes the string or axis causing the ball to bounce backwardly and thus not be collected in the collecting system. It is not always possible for the pitcher always to see where he had thrown a baseball. To overcome this, some patents have used complicated electronic devices to indicate where the baseball was thrown.

By throwing the baseball into a mat, which is sufficiently soft and heavy to absorb the impact of the pitch, an indentation in the mat will occur showing the pitcher where the last ball has struck. Also, the baseball will drop, no matter where the baseball strikes the mat, down to the collecting means. Providing the baseball is sufficiently well thrown so as to enter the retaining chamber, even if it fails and strikes the mat, it will be returned to the pitcher because the baseball which missed the mat will strike the tarpaulin to the rear of the mat. Since the mat is recessed within the retaining chamber, the slight extent that the baseballs bounce backwardly from the mat will not be sufficient for the baseballs to bounce out of the retaining chamber.

Of course, an extremely wild pitch outside the perimeter of the retaining enclosure will not be returned, but by making the retaining enclosure substantially larger than the strike zone which is the same as the mat size, most all baseballs thrown, even by the least experienced pitcher, will be returned to the pitcher by means of this invention.

Many of the devices already known, although workable, are expensive to build. Those using motors and conveyors and using electronic systems for signaling obviously are expensive. Furthermore, they are heavy to move and require electrical energy at the site. Frequently, an electrical power source is not available in parks and fields where pitchers practice.

What is needed is an inexpensive device that can readily be put together and dissassembled and which is sufficiently light to be moved onto a practice area without need of an available electrical source and which provides the pitcher with knowledge of where his ball has been thrown, retains the baseball and returns the baseball to the pitcher by gravity.

The use of the invention provides a lightweight pitching device for training a baseball pitcher which can be used in any location and can be readily assembled and moved and is sufficiently inexpensive so as to be available not only to professional ball players, but by children and other amateurs wishing to practice the art of proper pitching.

These and various other problems were not satisfactorily resolved until the emergence of the instant invention.

SUMMARY OF THE INVENTION

In accordance with the present invention, there is provided an inexpensive and light-weight pitching device for training a baseball pitcher. An enclosure provides a retaining chamber with a collecting means in the lower portion of the retaining chamber. The enclosure is formed from two end frames each vertically located. Each end frame has a horizontal top portion, a curved back portion and a horizontal bottom portion. The two end frames are connected by a plurality of horizontal oriented cross members. The enclosure thus formed has a top area, a bottom area, a front area, and a back area, and two side areas. Netting is placed over the top area, the bottom area, the back area, and side areas of the enclosure to form the retaining chamber. In the lower portion of the retaining chamber is a collecting means including a floor panel. The floor panel slopes downwardly and can be adjusted toward either side of the enclosure and downwardly away from the rear of the enclosure toward the front area of the enclosure. A front panel is located across the front of the lower portion of the enclosure adjacent to the floor panel. The front panel has an opening in it adjacent the lower end of the floor panel. A chute means is connected to the opening in the front panel to receive the baseballs collected in the collecting chamber and direct them downwardly by gravity along the chute back to the pitcher.

A mat which is situated within the retaining chamber so as to simulate the strike zone, as defined by the game of baseball, is mounted inside the retaining chamber recessed from the front of the enclosure so that when baseballs strike the mat, the baseballs will drop into the collecting means. Balls which miss the mat but are within the periphery of the front area of the enclosure will strike the tarpaulin will also drop down into the collecting means.

A base means is provided to locate the enclosure a short distance above the ground at a proper height to place the mat in the strike zone and generally centrally in the enclosure. The location of the mat is preferably adjustable so as to change its location to the proper strike zone for batters of different heights.

The novel features, which are considered as characteristic of the invention, are set forth with particularity in the appended claims. The invention itself, however, as to its construction and obvious advantages, will be best understood from the following description and the specific embodiment when read with the accompanying drawings.

DETAILED DESCRIPTION OF THE INVENTION

Figure 1:
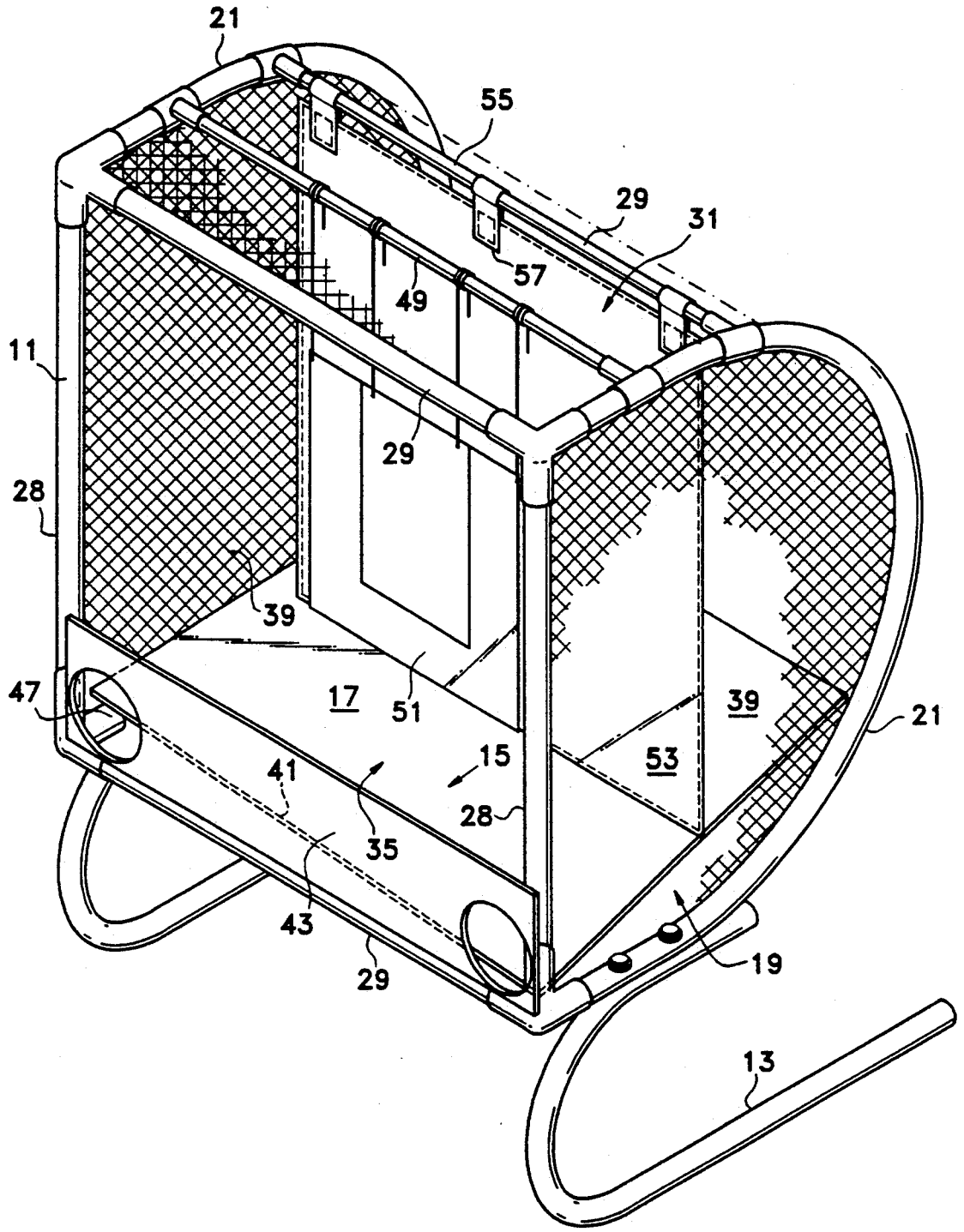
FIG. 1 is a perspective view of the pitching device showing the enclosure with the mat and tarpaulin vertically suspended within the enclosure and the base on which the enclosure is mounted and showing the retaining chamber and the collecting means and the openings in the front panel with the floor panel sloping to one of the openings.
Figure 2:
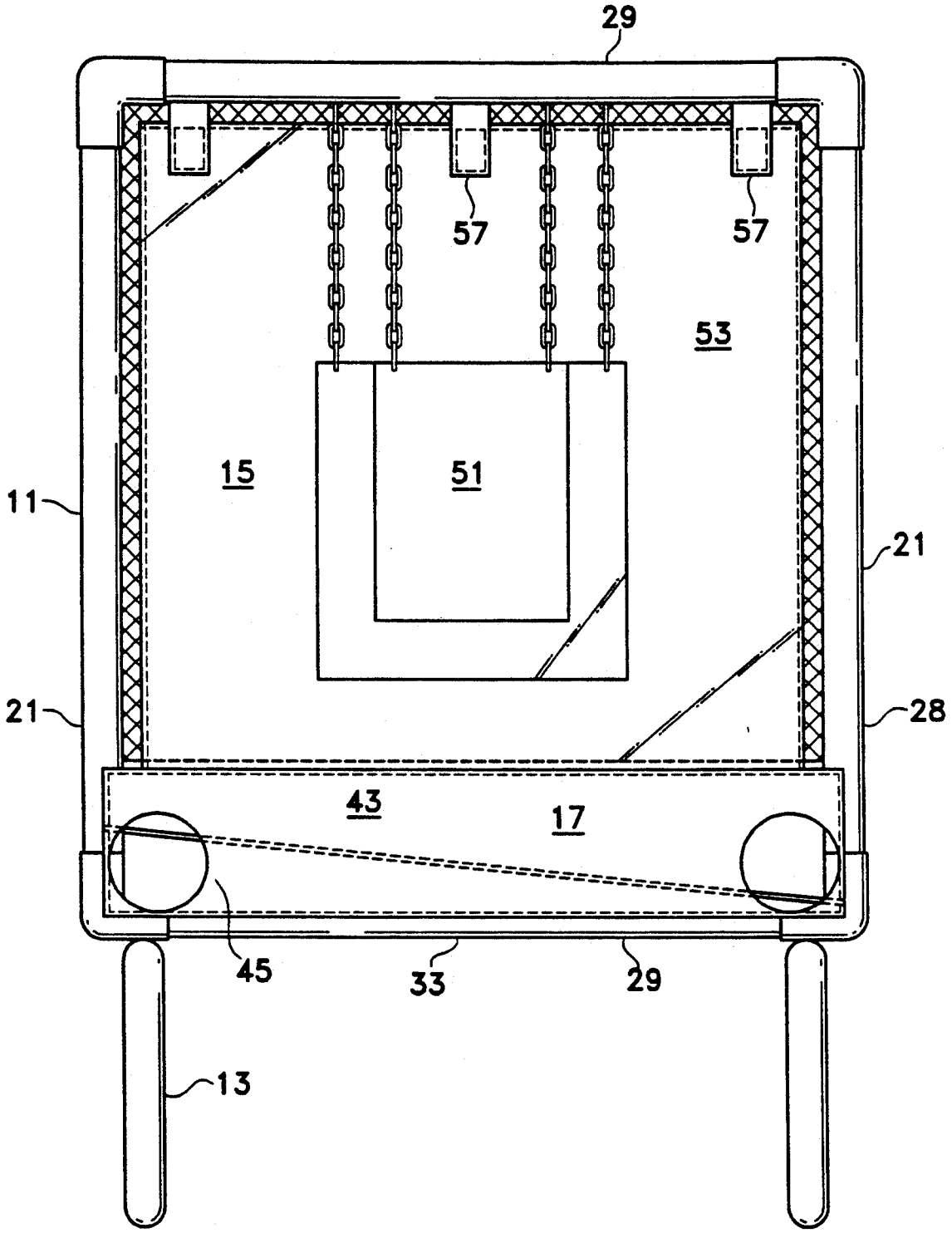
FIG. 2 is a front elevation of the pitching device showing the enclosure and the mat in place with the tarpaulin to the rear of the mat and showing the front panel with the floor panel sloping to one of the openings in the front panel as well as the support on which the upper end of the floor panel is mounted.
Figure 3:
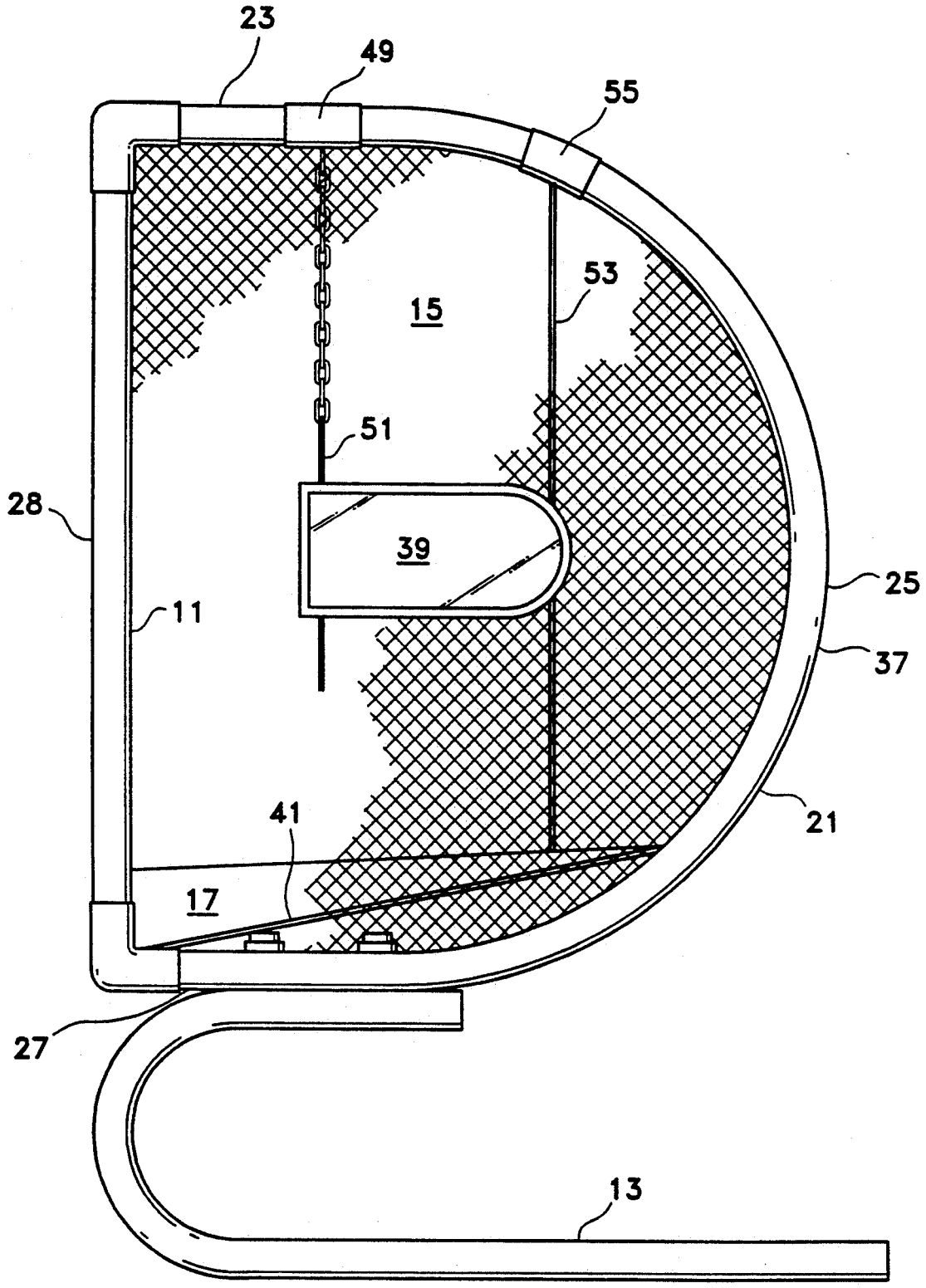
FIG. 3 is a side elevation also showing the mat and the tarpaulin suspended within the retaining chamber of the enclosure with the collecting means at the base or lower portion of the enclosure and the retaining chamber with the floor panel shown sloping from back to front.

The same reference numerals are used throughout the drawings and specification to note a similar item of the invention.

Referring now to the drawings, an enclosure 11 is shown mounted on a base or mounting means 13. The mounting means or base 13 may be formed in any particular manner, but a modernistic curved base 13 is shown which is simple to construct particularly with modern plastics and which is both strong and light in weight. Above the mounting means 13 and secured to it is the enclosure 11 which has a D-shape. The enclosure 11 forms a retaining chamber 15 with a collecting means 17 in the lower portion or bottom 19 of the retaining chamber 15. The retaining chamber stops and confines baseballs causing the baseballs to drop to the collecting means which directs the baseballs to a chute which returns by gravity the baseballs to the pitcher.

The enclosure is formed with two end frames 21. Each end frame 21, consistent with the D-shape of the enclosure 11, also has a D-shape with a horizontal top portion 23, a curved back portion 25, a horizontal bottom portion 27 and a vertical front portion 28. The horizontal bottom portion 27 is directly below the horizontal top portion 23. The two end frames are connected to one another by a series of horizontally located cross members 29. The enclosure 11 includes a top area 31, a bottom area 33, a front area 35, and a back area 37 as well as two side areas 39. Netting is placed over the top area 31, bottom area 33, back area 37, and both side areas 39 of the enclosure 11 to form the retaining chamber 15.

In the bottom or lower portion of the enclosure 11, a floor panel 41 is located. The floor panel 41 slopes downwardly toward one side area 39 of the enclosure 11. The floor panel 41 may slope toward either side area 39. The floor panel 41 also slopes downwardly from the back area 37 of the enclosure toward the front area 35. A front panel 43 is located across the front area 35 at the lower portion of the enclosure 11 and adjacent the floor panel 41. Preferably openings 45 are located at both ends of the front panel 43 adjacent each side area 39 of the enclosure 11 to permit the pitching device to return baseballs from either side The opening 45 that will be used will be where the lowest point of the floor panel 41 is located. A horizontal support 47 extends from the front panel 43 adjacent each opening 45 and adjacent the respective side area 39. The floor panel 41 is rested on the horizontal support 47 by the opening 45 not to be cross members 29 previously referred to, may be located at any point necessary to provide adequate strength between the two end frames 21. However, approximately midway in the horizontal top portion 23 of each end frame 21, a forward suspension cross member 49 is extended between the two end frames 21. The forward suspension cross member 49, besides serving the function of the other cross members 29, also provides a support for suspending a mat 51 which is used as a target by the pitcher. Chains 52 are shown for suspending the mat 51 from the forward suspension cross member, but, ropes, or cables may also be used. It is best to suspend the mat 51 so that the mat 51 can be moved up and down to raise or lower the mat 51 so as to adjust the mat 51 to the proper position for the strike zone of batters of varying heights. The mat 51 is thereby recessed within the retaining chamber 15 of the enclosure 11 behind the front area 35 toward the back area 37 and directly above the collecting means 17. The mat 51 is constructed of a soft material which has low resilience which absorbs the impact of the baseball. Thus, when a baseball is thrown at the mat 51 and strikes the mat 51, the baseball will not bounce off the mat 51 a sufficient distance to bounce out of the retaining chamber 15, but will drop down into the collecting means 17. Once at the bottom of the retaining chamber 17, the baseball will roll downwardly along the floor panel 41 to the opening 45 in the front panel 43 adjacent the low end of the floor panel 41. The baseball will roll out of the opening 45 and then roll down the chute which has sufficient height at the enclosure to cause the baseball to roll along the chute (not shown) back to the pitcher. If a baseball which is thrown fails to enter the front area 35 of the enclosure 11, needless to say, it will not be returned and will have to be retrieved. If, however, it fails to strike the mat 51, but enters the retaining chamber 15, it will strike a tarpaulin 53 suspended behind the mat 51 in the retaining chamber 15 and drop to the collecting means 17 and then follow the same route along the floor panel 41 to the chute back to the pitcher as if the baseball had dropped from the mat 51. The tarpaulin 53 is suspended to stop any baseball which enters the enclosure 11 but fails to strike the mat 51. A rear suspension cross member 55 serves to support the tarpaulin 53 behind the mat 51. Straps 57 or similar means are used to support the tarpaulin 53 from the rear suspension cross member 55. The tarpaulin 53 is almost as large as the front area 35 above the front panel 43 and thus is larger in area than the mat 51. Since the tarpaulin 53 covers the entire accessible area of the front area 35.

The present invention may be embodied in other specific forms without departing from the spirit or essential characteristics thereof. The present embodiments are, therefore, to be considered in all aspects as illustrative and not restrictive. The scope of the invention is indicated by the appended claims rather than the foregoing description and all changes which come within the meaning of the range of equivalency of the claims are, therefore, intended to be embraced therein.

I claim:

1. A pitching device for training a baseball pitcher to throw a baseball to the strike zone of a baseball batter, said pitching device comprising:

an enclosure including both a retaining chamber and a collecting means, the enclosure having a top area, a bottom area, a front area, a back area and two side areas;

a netting substantially covering the enclosure to form the retaining chamber;

a floor panel adjacent but in a spaced relationship to the bottom area, said floor panel being attached to said enclosure such that it may be sloped downwardly toward either side area of the enclosure and downwardly away form the rear area of the to cause balls to roll by gravity towards one of said sides;

a front panel across the front area adjacent to the bottom area and the floor panel, said front panel having at least one opening therein, adjacent at least one of said side areas the floor panel and front panel said at least one opening defining means to expel balls from said enclosure;

a target means defining a strike zone of a baseball batter;

means for mounting the target means in the retaining chamber towards the back area behind the front area and above the collecting chamber; and a base means, the enclosure being mounted on the base means.

2. A pitching device for training a baseball pitcher according to claim 1 wherein the enclosure is defined by two end frames, a curved back portion, a top portion and a horizontal bottom portion.

3. A pitching device for training a baseball pitcher according to claim 1 wherein the target means includes a mat of low resilience.

4. A pitching device for training a baseball pitcher according to claim 1 wherein:

the enclosure is defined by two end frames, a curved back portion, a top portion and a horizontal bottom portion; and said target means includes a mat of low resilience.

5. A pitching device for training a baseball pitcher according to claim 1 wherein the enclosure is defined by two vertically extending frames, each said end frame having a D-shape with a horizontal top portion, a curved back portion and a horizontal bottom portion, the two end frames being connected by a plurality of horizontally-mounted cross-members.

6. A pitching device for training a baseball pitcher according to claim 1 having a tarpaulin suspended vertically and horizontally behind the target means.

* * * * *